US012227943B2

(12) United States Patent
Brett

(10) Patent No.: US 12,227,943 B2
(45) Date of Patent: Feb. 18, 2025

(54) ASSEMBLIES FOR SUSPENDING CEILING PANELS

(71) Applicant: Polygrid Pty Ltd, Plenty (AU)

(72) Inventor: Paul Adrian Brett, Plenty (AU)

(73) Assignee: POLYGRID PTY LTD, Plenty (AU)

( * ) Notice: Subject to any disclaimer, the term of this patent is extended or adjusted under 35 U.S.C. 154(b) by 0 days.

(21) Appl. No.: 17/673,330

(22) Filed: Feb. 16, 2022

(65) Prior Publication Data

US 2022/0170266 A1 Jun. 2, 2022

Related U.S. Application Data

(62) Division of application No. 16/645,681, filed as application No. PCT/AU2017/050977 on Sep. 8, 2017, now Pat. No. 11,286,666.

(51) Int. Cl.

| | |
|---|---|
| ***E04B 9/14*** | (2006.01) |
| ***E04B 9/10*** | (2006.01) |
| ***E04B 9/16*** | (2006.01) |
| ***E04B 9/20*** | (2006.01) |
| ***E04B 9/34*** | (2006.01) |

(52) U.S. Cl.

CPC ..... *E04B 9/14* (2013.01); *E04B 9/10* (2013.01); *E04B 9/16* (2013.01); *E04B 9/205* (2013.01); *E04B 9/34* (2013.01)

(58) Field of Classification Search

CPC ... E04B 9/14; E04B 9/16; E04B 9/205; E04B 9/34; E04B 9/10

USPC .. 52/668, 667, 506.05, 665, 506.08, 506.07, 52/506.06

See application file for complete search history.

(56) References Cited

U.S. PATENT DOCUMENTS

| | | | | |
|---|---|---|---|---|
| 2,240,592 A * | 5/1941 | Wilson | E04H 1/02 52/261 |
| 3,089,570 A | 5/1963 | Oneil, Jr. | |
| 3,096,862 A | 7/1963 | Purdy | |
| 3,097,730 A * | 7/1963 | Halle | E04B 1/2403 403/173 |
| 3,466,830 A | 9/1969 | Smith | |
| 3,696,571 A * | 10/1972 | Schluter | E04B 9/34 52/506.06 |

(Continued)

FOREIGN PATENT DOCUMENTS

| | | |
|---|---|---|
| CN | 1676806 A | 10/2005 |
| CN | 202866098 U | 4/2013 |

(Continued)

OTHER PUBLICATIONS

International Search Report and Written Opinion from PCT/AU2017/050977, mailed Nov. 28, 2017 (14 pages).

(Continued)

*Primary Examiner* — Brent W Herring
(74) *Attorney, Agent, or Firm* — Quarles & Brady, LLP

(57) ABSTRACT

An assembly for suspending ceiling panels, having a frame and suspension members for suspending the frame from a structure, the frame having intersection members and support members extending therebetween, each support member being for supporting a respective side of the ceiling panel, and wherein the ends of the support members are configured to engage with engageable portions provided circumferentially about each of the intersection members.

17 Claims, 14 Drawing Sheets

(56) References Cited

U.S. PATENT DOCUMENTS 3,785,110 A * 1/1974 Galloway ..... E04B 9/14 52/715
4,004,390 A * 1/1977 Merkwitz ..... E04B 9/14 404/1
4,235,559 A * 11/1980 Rooklyn ..... F16B 12/30 403/171
4,294,054 A 10/1981 Kuhr
4,398,841 A * 8/1983 Kojima ..... F16B 7/22 52/645
4,438,613 A 3/1984 Hintsa et al.
4,494,350 A 1/1985 Sharp
4,548,010 A 10/1985 Hintsa
4,549,375 A 10/1985 Nassof
4,724,650 A * 2/1988 Carey ..... E04B 9/14 52/650.3
5,289,665 A * 3/1994 Higgins ..... E04B 5/43 52/655.1
5,469,681 A * 11/1995 Wu ..... E04B 9/14 52/669
D373,831 S 9/1996 Lechleiter et al.
5,803,782 A * 9/1998 Selton ..... A47B 47/005 446/125
5,996,288 A * 12/1999 Aiken ..... E04B 1/3211 52/81.3
6,158,186 A * 12/2000 Feller ..... E04B 9/14 52/506.07
6,735,917 B1 * 5/2004 Notermann ..... B62D 27/026 52/656.9
6,782,670 B2 8/2004 Wendt
D517,900 S * 3/2006 Goldenberg ..... D8/354
7,770,349 B2 * 8/2010 Tedesco ..... E04B 9/122 52/506.07
8,079,192 B2 12/2011 Gerkes et al.
8,469,438 B2 6/2013 Mazur et al.
8,590,216 B1 * 11/2013 Hurt, III ..... E04B 1/3211 52/81.3
9,260,863 B2 2/2016 Thun et al.
10,844,599 B2 * 11/2020 Rimmer ..... E04B 9/225
2003/0121227 A1 7/2003 Wendt
2005/0072090 A1 4/2005 Mclaughlin
2005/0166509 A1 8/2005 Sareyka et al.
2011/0219718 A1 9/2011 Gerkes et al.
2012/0055109 A1 3/2012 Labonte et al.
2014/0037366 A1 2/2014 Groza et al.
2015/0060193 A1 3/2015 Thun et al.
2017/0241125 A1 * 8/2017 Higgins ..... E04H 15/62
2017/0307191 A1 * 10/2017 Neal ..... F21V 21/048
2019/0022443 A1 * 1/2019 Beagen ..... E04B 9/14

FOREIGN PATENT DOCUMENTS

DE 2728912 A1 1/1979
DE 3734743 A1 4/1989
EP 2546430 B1 1/2014
TW 201405020 A 2/2014

OTHER PUBLICATIONS

Office Action for counterpart Chinese Patent Application No. 201780096322.2, dated May 6, 2021. (27 pages).
Search Report for corresponding European Patent Application No. 17847820.2, dated Mar. 30, 2021 (8 pages).

* cited by examiner

ASSEMBLIES FOR SUSPENDING CEILING PANELS

CROSS-REFERENCE TO RELATED APPLICATIONS

This application is a divisional of U.S. patent application Ser. No. 16/645,681, filed on Mar. 9, 2020, and entitled "ASSEMBLIES FOR SUSPENDING CEILING PANELS," which is a U.S. National Stage application, filed pursuant to 35 U.S.C. § 371, of International Application No. PCT/AU2017/050977, filed on Sep. 8, 2017, and entitled "ASSEMBLIES FOR SUSPENDING CEILING PANELS," each of which are incorporated herein by reference in their entirety and are to be considered a part of this application.

BACKGROUND OF THE INVENTION

Suspended ceiling systems provide a grid structure for suspending light-weight panels to form a ceiling in commercial environments such as office or retail spaces. The panels can be used to hide the upper space of a room which can contain wiring, conduit, piping or ductwork. Designers often desire the installation of visually different suspended ceilings other than those that can suspend standard square or rectangular panels. However this can involve complex and expensive installation.

Examples of the invention seek to avoid or to at least ameliorate problems of existing suspended ceiling systems.

BRIEF SUMMARY OF THE INVENTION

According to a first aspect of the present invention, there is provided an assembly for suspending ceiling panels, having a frame and suspension members for suspending the frame from a structure, the frame having intersection members and support members extending there between, each support member being for supporting a respective side of the ceiling panel, and wherein the ends of the support members are configured to engage with engageable portions provided circumferentially about each of the intersection members. Advantageously, there is provided an assembly that can be easily formed for suspending ceiling panels.

According to an embodiment, the positions of the engageable portions are arranged such that the angles between adjacent ends of the support members so engaged in the intersection members correspond to the respective interior angles of the ceiling panel thereby forming a grid for suspending the ceiling panels.

According to an embodiment, wherein the engageable portions are arranged equiangularly about the intersection member.

According to an embodiment, the assembly has at least two said frames, wherein the suspension members are adapted to engage with the frames so as to support the frames in a spaced-apart vertical configuration one above the other thereby providing a suspended ceiling with at least two levels.

According to a second aspect of the present invention, there is provided an assembly for suspending ceiling panels having at least two frames, each frame being for suspending at least one of said ceiling panels, and suspension members for suspending the frames from a structure, wherein at least some of the suspension members are adapted to engage with the frames so as to support the at least two frames in a spaced-apart vertical configuration. Advantageously, there is provided an assembly that can be easily formed for providing a suspended ceiling having at least two levels of ceiling panels.

According to an embodiment, the frame has intersection members and support members extending therebetween, and wherein an intersection member of each frame is engageable with one of said suspension members such that one of the intersection members is supported above the other.

According to an embodiment, the intersection member on an upper portion of the suspension member has an aperture in a base thereof configured to allow the suspension member to be received therethrough such that the intersection members engaged to the suspension member are positionable substantially vertically one above the other. Preferably, the aperture is substantially the size of the cross-section of the suspension member.

According to an embodiment, the intersection member has a transverse element internal to the intersection member which has a further aperture, the transverse element being spaced apart from the base. Preferably, the further aperture is substantially the size of the cross-section of the suspension member.

According to an embodiment, the opposed ends of the support members are configured to engage with engageable portions provided circumferentially about each of the intersection members.

According to an embodiment, the engagement of opposed ends of the or each support member and respective engageable portion is a latching engagement.

According to an embodiment, the positions of the engageable portions are arranged such that the angles between adjacent ends of the support members so engaged in the intersection members correspond to the respective interior angles of the ceiling panel thereby forming a grid for suspending the ceiling panels.

According to an embodiment, the engageable portions are arranged equiangularly about the intersection member(s).

According to an embodiment, the frame(s) has support members so engaged in said intersection members to define openings wherein the shape of the openings correspond to the shape of the ceiling panel(s), each side of the ceiling panel(s) being supportable by a respective support member.

According to an embodiment, each ceiling panel is in the shape of a regular polygon.

According to an embodiment, each ceiling panel has the same regular polygonal shape.

According to an embodiment, the ceiling panel(s) has three, four, five, six or eight sides.

According to an embodiment, at least two adjacent ends of support members form an angle of 60° when so engaged in each of three of said intersection members so as to form an assembly for suspending at least one triangle shaped ceiling panel.

According to an embodiment, at least two adjacent ends of support members form an angle of 120° when so engaged in each of six of said intersection members so as to form an assembly for suspending at least one hexagonally shaped ceiling panel.

According to an embodiment, at least two adjacent ends of support members when so engaged in each of four of said intersection members form an angle of 90° so as to form an assembly for suspending at least one quadrilateral shaped ceiling panel.

According to an embodiment, two adjacent ends of support members form an angle of 108° when so engaged in each of five of said intersection members so as to form an assembly for suspending at least one pentagonal shaped ceiling panel.

According to an embodiment, at least two adjacent ends of support members form an angle of 135° when so engaged in each of eight of said intersection members so as to form an assembly for suspending at least one octagonal shaped ceiling panel.

Advantageously, there is provided assemblies that can be easily formed for suspending ceiling panels having shapes of regular polygons, including those having three, four, five, six or eight sides.

According to an embodiment, the engageable portions are in the form of apertures so as to engagingly receive protrusions provided at the opposed ends of the support structures.

According to an embodiment, the engageable portions are in the form of protrusions so as to be engagingly received in apertured portions provided at the opposed ends of the support structures.

According to an embodiment, the engagement of the protrusions and apertured portions is a latching engagement.

According to an embodiment, the or each protrusion has at least one locating member for inhibiting withdrawal of the or each protrusion from the respective apertured portion.

According to an embodiment, the at least one locating member for inhibiting withdrawal of the or each protrusion is in the form of a resilient tongue, wherein, when the at least one locating member is inserted into the apertured portion, a side edge of the apertured portion engages and depresses the tongue so the tongue is insertable through the apertured portion, and wherein, when the protrusion and tongue have passed through the apertured portion, the tongue moves outwardly under resilient bias to engage with the inner wall of the intersection member to inhibit withdrawal of the support member.

According to an embodiment, the or each support member has at least one locating member for inhibiting further inward movement of the protrusion into the respective apertured portion.

According to an embodiment, the or each protrusion has at least one locating member for inhibiting further inward movement of the protrusion into the respective apertured portion.

According to an embodiment, each apertured portion is a slot.

According to an embodiment, the suspension member is in the form of a rod.

According to an embodiment, each intersection member is engageable to the suspension member by a fastener.

According to an embodiment, the fastener is releasably movable relative to the suspension member so as to be able to adjust the position of the intersection member relative to the suspension member.

According to an embodiment, a lower end portion of the fastener is configured as a hook receivable in an apertured portion of the intersection member.

According to a third aspect of the present invention, there is provided an intersection member having engageable portions provided circumferentially thereabout, the engageable portions being engageable with the ends of the support members.

According to an embodiment, the intersection member has an opening configured to allow the suspension member to be received therethrough.

According to a fourth aspect of the present invention, there is provided a suspended ceiling having an assembly as described above and at least one ceiling panel suspended thereby.

According to an embodiment, the suspended ceiling has an assembly with least one intersection member as described above and at least one ceiling panel suspended thereby.

According to an embodiment, the at least one ceiling panel is removable.

According to an embodiment, the support members have flanges for supporting sides of the at least one ceiling panel.

According to an embodiment, the at least one ceiling panel has the shape of a regular polygon having 3, 4, 5, 6 or 8 sides.

The invention also provides an intersection member having engageable portions arranged about the periphery of a mounting member thereof and adapted to receive end protrusions of support members of a suspended ceiling, such that when so received the end protrusions extend outwardly from the intersection member to provide support for ceiling panels, the engageable portions being disposed adjacent at an end of the intersection member at which there is provided a base extending outwardly from the mounting member.

The mounting member may be of tubular configuration and the engageable portions may be slots extending in the axial direction of the mounting member, and through the wall of the mounting member.

The base may define an array of outwardly extending support portions for support thereon of support members having the protrusions thereof received in the engageable portions.

The engageable portions and support portions may be equiangularly disposed about an axis of the intersection member.

The invention also provides an assembly for suspending ceiling panels having an intersection member as above described, having engaged therewith support members having said protrusions engaged with said engageable portions.

BRIEF DESCRIPTION OF THE SEVERAL VIEWS OF THE DRAWINGS

The present invention will now be described, by way of non-limiting example only, with reference to the accompanying drawings, in which.

DETAILED DESCRIPTION

Figure 1:
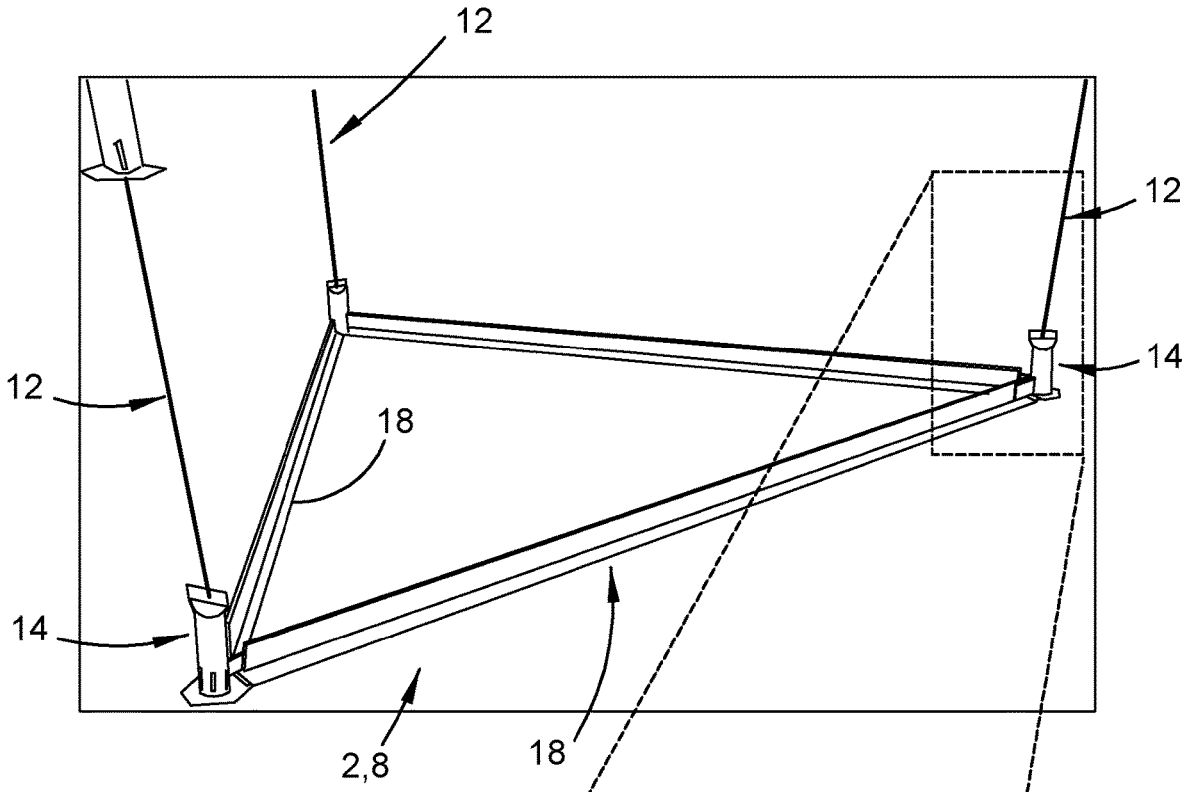
FIG. 1 is a perspective view of an assembly for suspending ceiling panels according to a first embodiment of the present invention having intersection members and support members.
Figure 2:
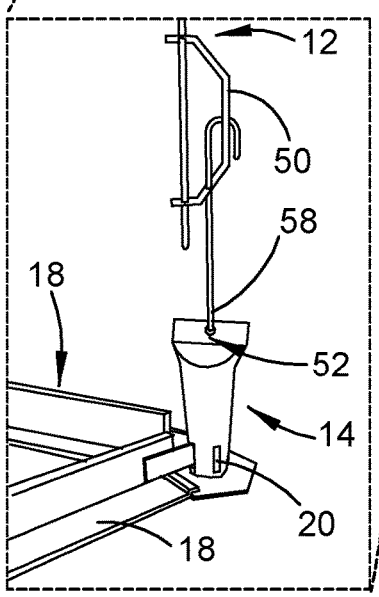
FIG. 2 is a close up view of a portion of the assembly of FIG. 1.

FIGS. 1 to 3A are views of assemblies 2, 4 for suspending ceiling panels 6 having respectively a frame 8 or two frames 8, 10, and suspension members 12 according to preferred embodiments of the present invention. The suspension members 12 are for suspending the frames 8, 10 from structure, such as an interior surface of a roof or a ceiling of a room.

Figure 3A:
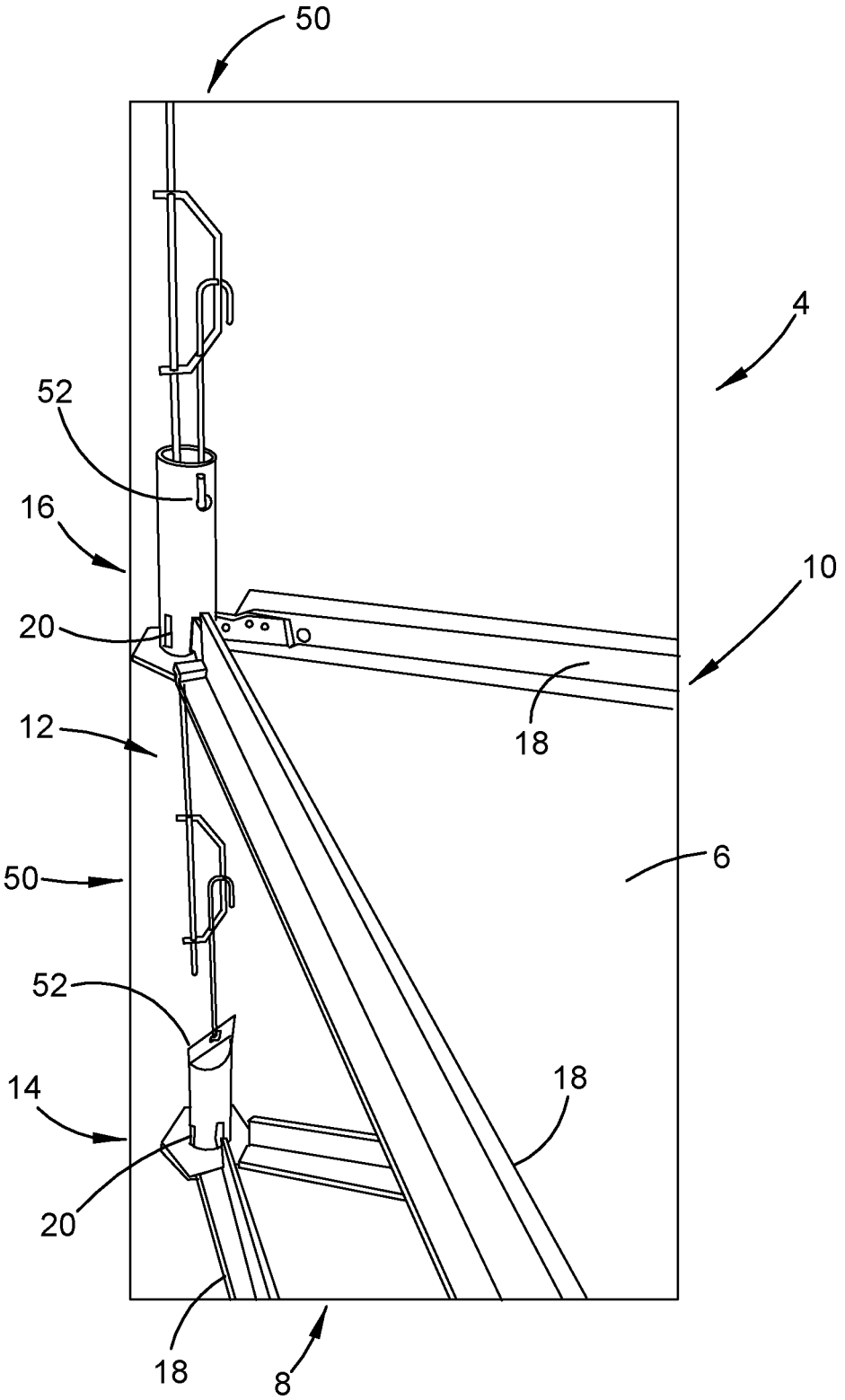
FIG. 3A is a perspective view of an assembly having two frames according to another embodiment of the present invention.
Figure 3B:
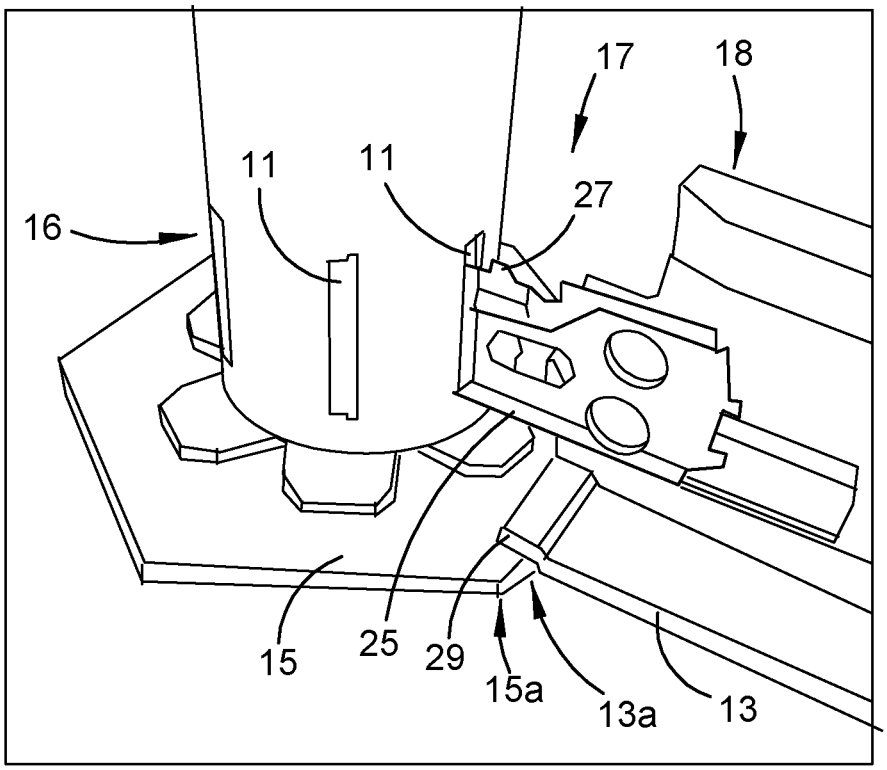
FIGS. 3B, 3C and 3K are perspective, front and side cross-section views respectively of an embodiment showing the connection of one of the intersection members and one of the support members of the assembly of FIGS. 1 and 2.
Figure 3C:
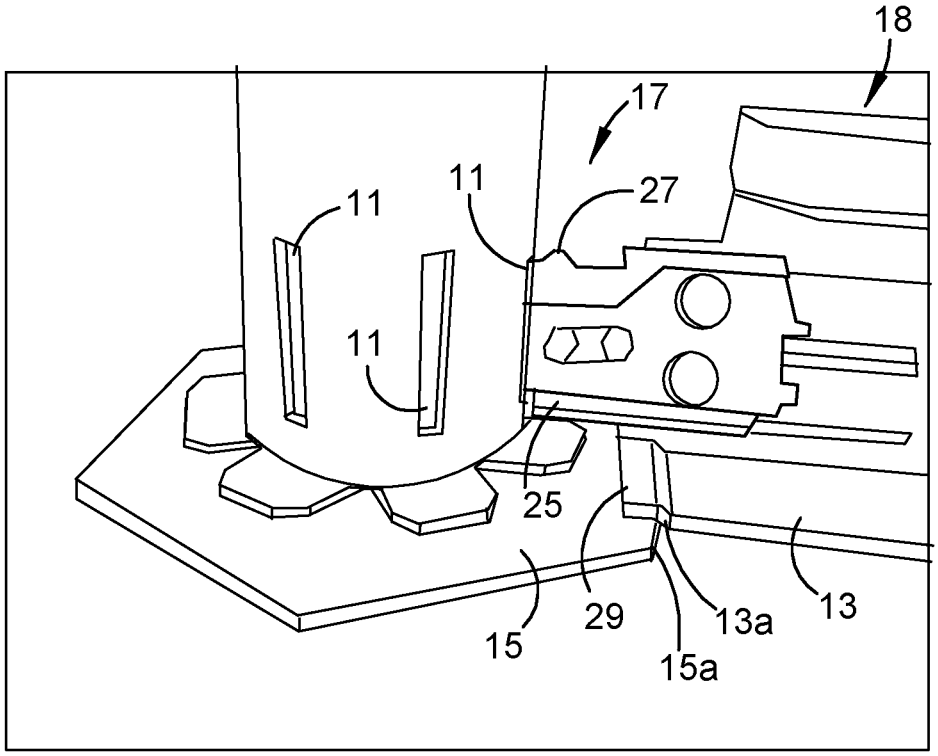
Figure 3D:
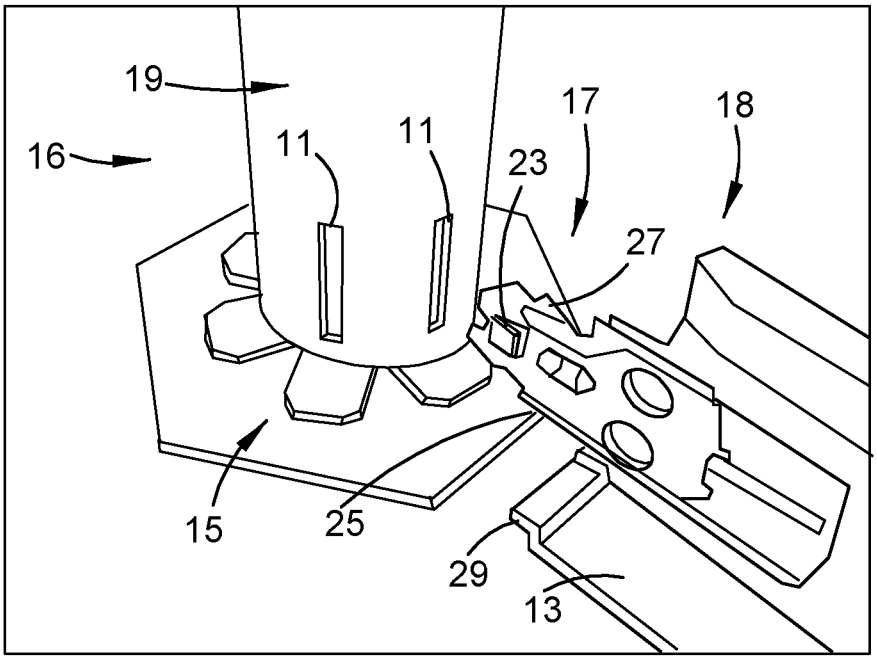
FIGS. 3D to 3J are perspective, front and top cross-section views showing a further embodiment of the connection of the support member and intersection member of the assembly shown in FIGS. 1 and 2.
Figure 3E:
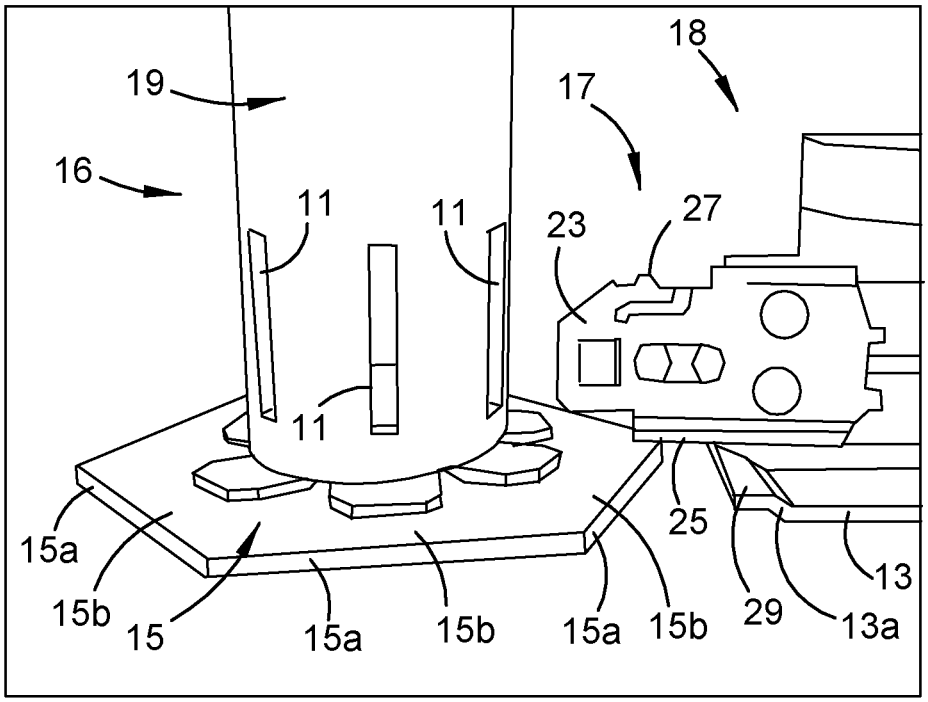
Figure 3F:
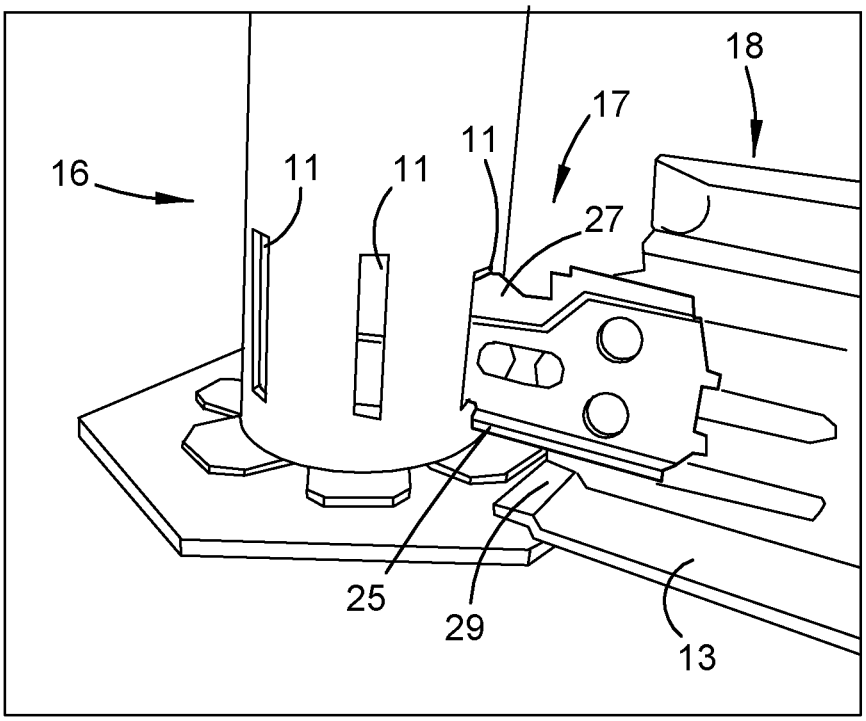
Figure 3G:
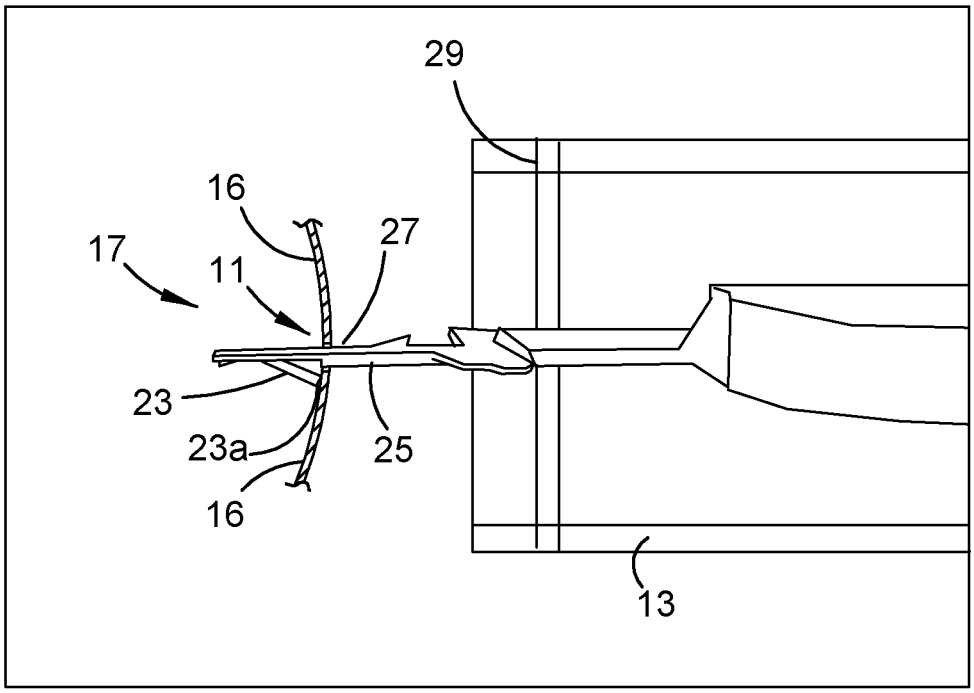

The frames 8, 10 have intersection members 14, 16 and support members 18 extending therebetween where each support member 18 supports a side of one of the ceiling panels 6. The intersection members 14, 16 have a generally tubular, axially extending, mounting member 19 and a base 15, which base is lowermost in use of the intersection member. The base 15 extends outwardly around the periphery of the mounting member 19, as a peripheral flange. The ends of the support members 18 are configured to engage with engageable portions 20 provided circumferentially about each of the intersection members 14, 16, the engageable portions 20 defining respective slot-like apertures which extend through the side wall of mounting member 19. Together, the support members and intersection members form a support grid having openings principally defined at the peripheries by the support members 18. The shape of these openings corresponds to the shape of the ceiling panels 6, each side of the ceiling panel 6 being supportable by a respective support member 18. That is, the support members 18 have flanges 13 on lower opposite longitudinal edges which receive thereon underside marginal portions of the ceiling panels 6, thereby supporting the ceiling panels 6 to form a suspended ceiling as shown in FIG. 3A.

FIGS. 3B to 3K show more detailed examples of the engagement of the support members 18 with the intersection member 14 or 16, where the engageable portions 20 are provided as apertures 11 which are adapted to receive protrusions 17 provided at the opposite ends of the support members 18. Alternatively, the engageable portions may be in the form of protrusions which are receivable in apertured portions provided at the opposed ends of the support members 18.

Figure 3H:
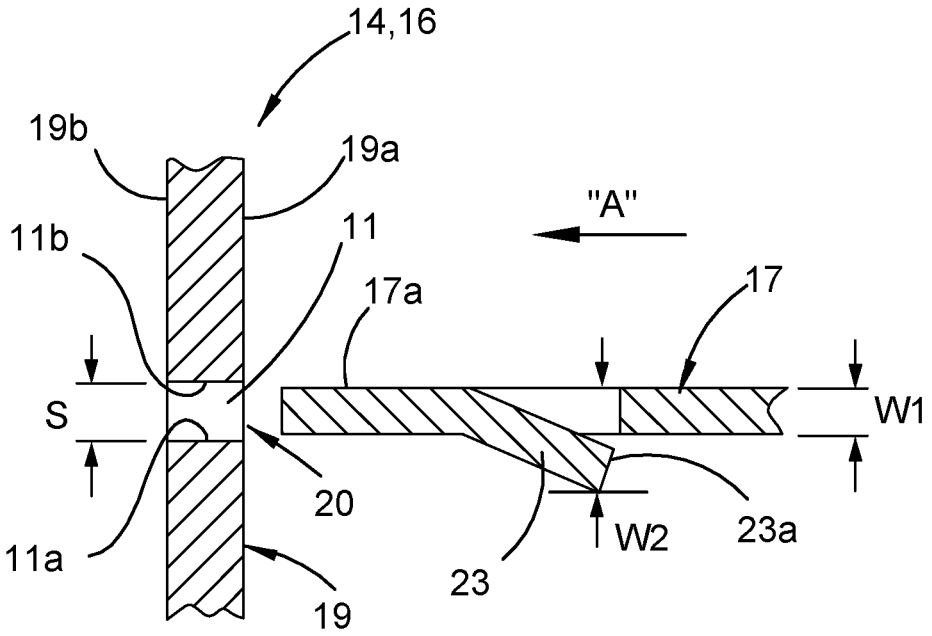
Figure 3I:
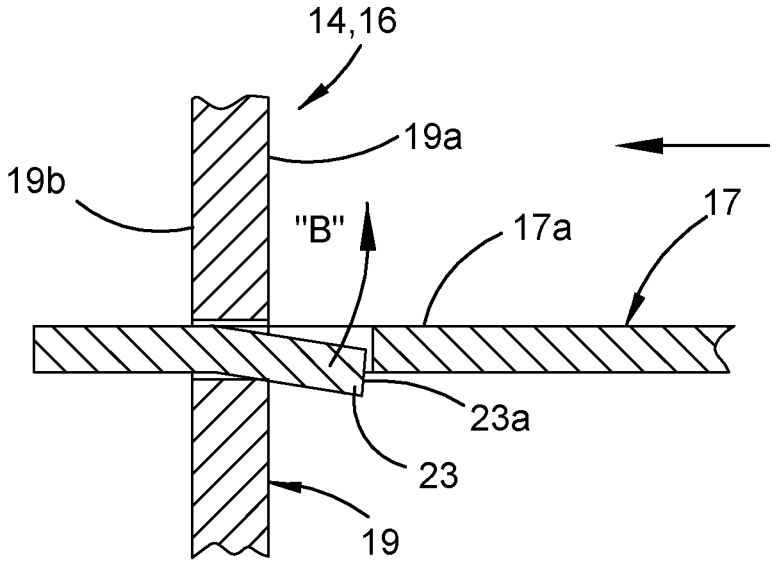
Figure 3J:
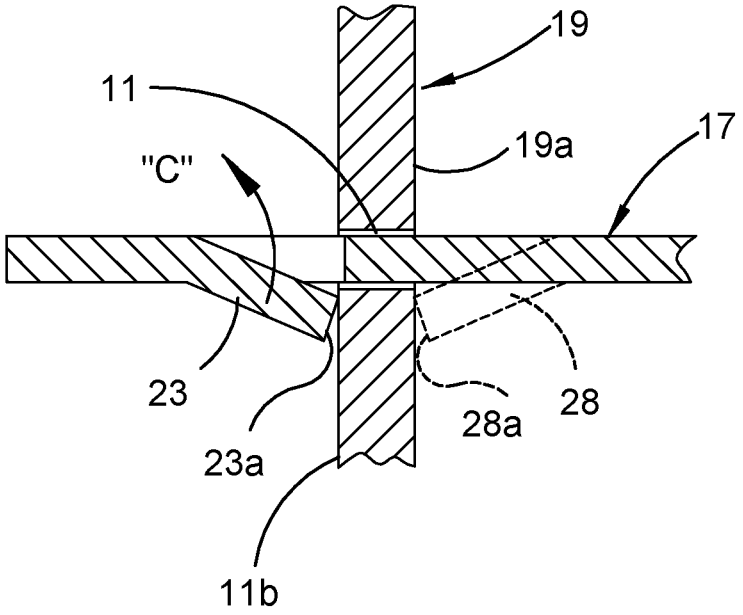

In the embodiment shown in FIGS. 3B, 3C, 3G and 3K, the illustrated protrusion 17 is latchingly engaged in an aperture 11. In an alternative embodiment shown in FIGS. 3D to 3J, the protrusion 17 is latchingly engaged laterally in the aperture 11. Both embodiments will be described further below. In any case, in FIGS. 3A to 3K, the intersection members 14, 16 are shown with the engageable portions 20 in the form of the described apertures 11 formed through the side wall 19*a* of the mounting member 19 and being arranged towards an end of the mounting member adjacent to the base 15 of the intersection member 14, 16. The locating member 23 is in the form of a punched-out resilient tongue extending sidewardly, and outwardly at an acute angle, from the remainder of the protrusion 17. Referring to FIGS. 3H, 3I and 3J, the width S of the aperture 11 is only slightly greater than the width W1 of the main body of the protrusion 17. At the location of the free end 23*a* of the locating member 23, the width W2 is greater than the width S. As the protrusion 17 is inserted into the aperture 11 (in the direction indicated by arrow A), one side edge 11*a* of the aperture 11 engages the locating member 23 such that the locating member 23 is depressed inwardly (in the direction indicated by arrow B) of the protrusion 17 by camming action against natural resilience of the locating member, the opposite face 17*a* of the protrusion 17 engaging the adjacent opposite surface 11*b* of the aperture 11. By this camming action, the protrusion 17 can pass through the aperture 11 until the locating member 23 has passed through it. Once the locating member 23 is clear of the aperture 11, the free end 23*a* of the locating member 23 moves outwardly under resilient bias (in the direction indicated by arrow C in FIG. 3J) from the protrusion 17 so that withdrawal of the support member 18 is inhibited by engagement of the free end 23*a* of the locating member 23 with the inner surface 19*b* of the side wall 19*a* of the mounting member 19 forming part of the intersection member 14 or 16.

Figure 3K:
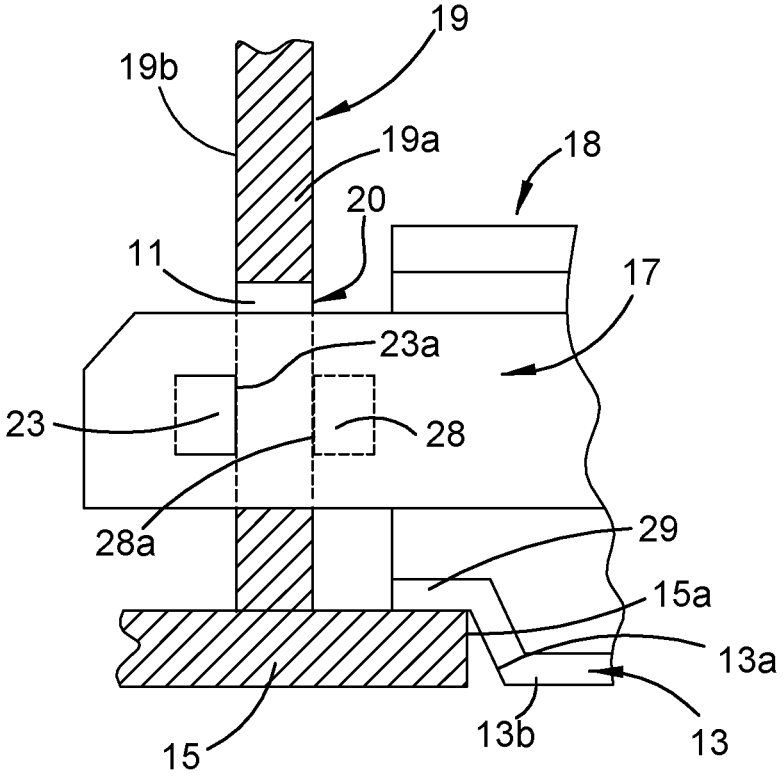

In the arrangement shown in FIGS. 3B, 3C, 3G and 3K, further inward movement of the protrusion 17 may be inhibited by engagement of a transverse locating member 29 on support member 18 and the base 15 of the intersection member 14 or 16. Thus an outer edge surface 15*a* of the base 15 engages a surface 13*a* of the flange 13. As exemplified in FIG. 3F, the protrusion 17 may have locating members 25 and/or 27 to provide an alternative engagement to inhibit further movement of the protrusion 17 into intersection member 14 or 16. Referring to FIG. 3K, additionally or alternatively, inwards movement of the protrusion 17 into the aperture 11, as mentioned, may be limited by engagement between a side edge 15*a* of the base 15 of the intersection member 14, 16 and a lower transverse 13*a* surface of the flanges 13 of the support member 18. A transverse locating member 29, forming parts of flange 13, extends side to side of the support member 18, slightly above the main lengthwise extending parts 13*b* (FIG. 3K) of the flanges 13, so as to define a step between the flanges and the transverse locating member 29. It is at this step that the surface 13*a* is defined; that is, as an end surface of flange parts 13*b*. Also as shown in FIG. 3K, in the assembled condition of the support member 18 and intersection member 14 or 16, the transverse locating member 29 rests on the base 15 so as to additionally or alternatively support the support member. Additionally or alternatively, inwards insertion of the protrusion may be limited by providing on the protrusion 17 a further locating member 28, shown in phantom lines in FIGS. 3J and 3K and in the form of a punched out tongue, like locating member 23, but oppositely directed, and with its free end 28*a* spaced from the free end of locating member by a distance substantially the same as the thickness of the wall 19*a*. As the protrusion reaches the latched position, shown in FIGS. 3J and 3K, the free end 18*a* is as shown brought into engagement with the outer surface of the wall 19*a*, to prevent further inwards movement.

Figure 8A:
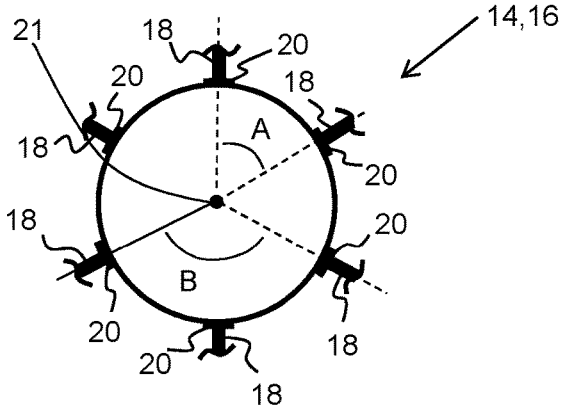
FIG. 8*a* is a cross-sectional view of the intersection member of FIGS. 6 and 7 taken through the line marked as X-X with engaged support members.
Figure 8B:
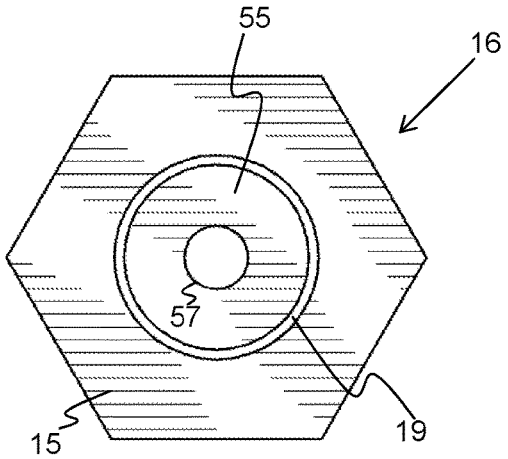
FIG. 8*b* is a top view of the intersection member of FIG. 6.

The intersection members 14, 16, shown in FIGS. 6 to 8*b*, have engageable portions 20 arranged equiangularly about the circumference of the intersection members 14, 16 wherein the angles formed between the engageable portions 20 and an axis 21 of the intersection members 14, 16 are represented as angle A, which corresponds to 60° (see FIG. 8*a*). This angle A corresponds to the angle of a corner of an equilateral triangle, known as an interior angle. Therefore the assemblies 2, 4 having intersection members 14, 16 and support members 18 form a grid 22 in which there are openings which can suspend ceiling panels 6 in the shape of equilateral triangles to form a suspended ceiling 24.

Figure 5:
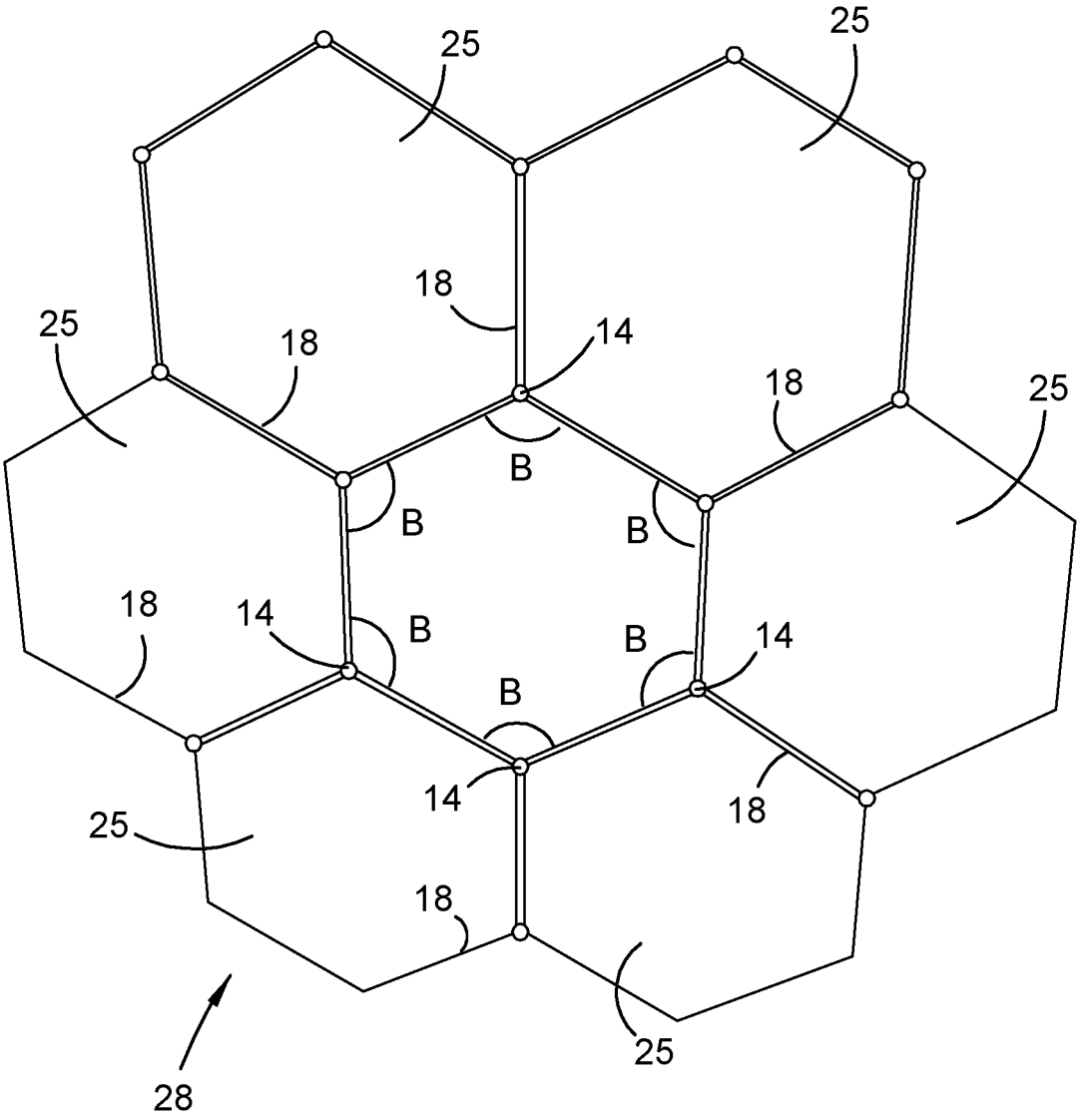
Figure 6:
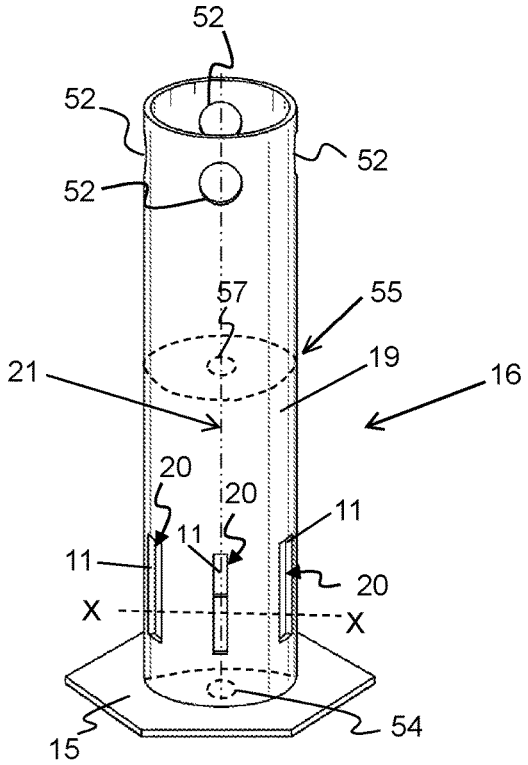
FIG. 6 is a perspective view of an intersection member of a upper frame for engaging with a suspension member.
Figure 7:
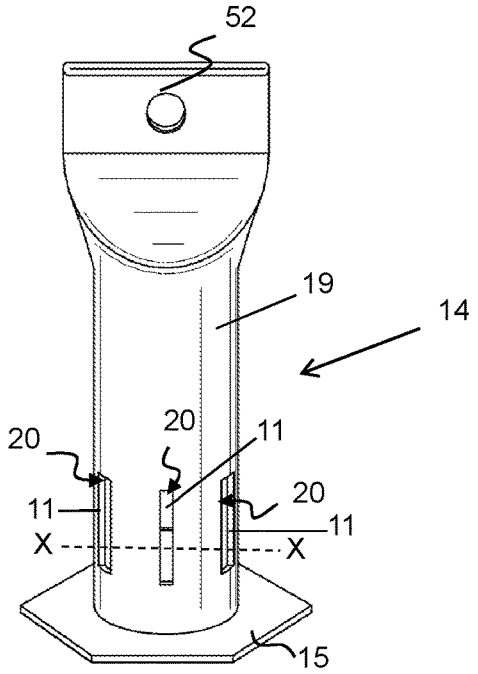
FIG. 7 is a perspective view of an intersection member of a lower frame for engaging with the suspension member.
Figure 10:
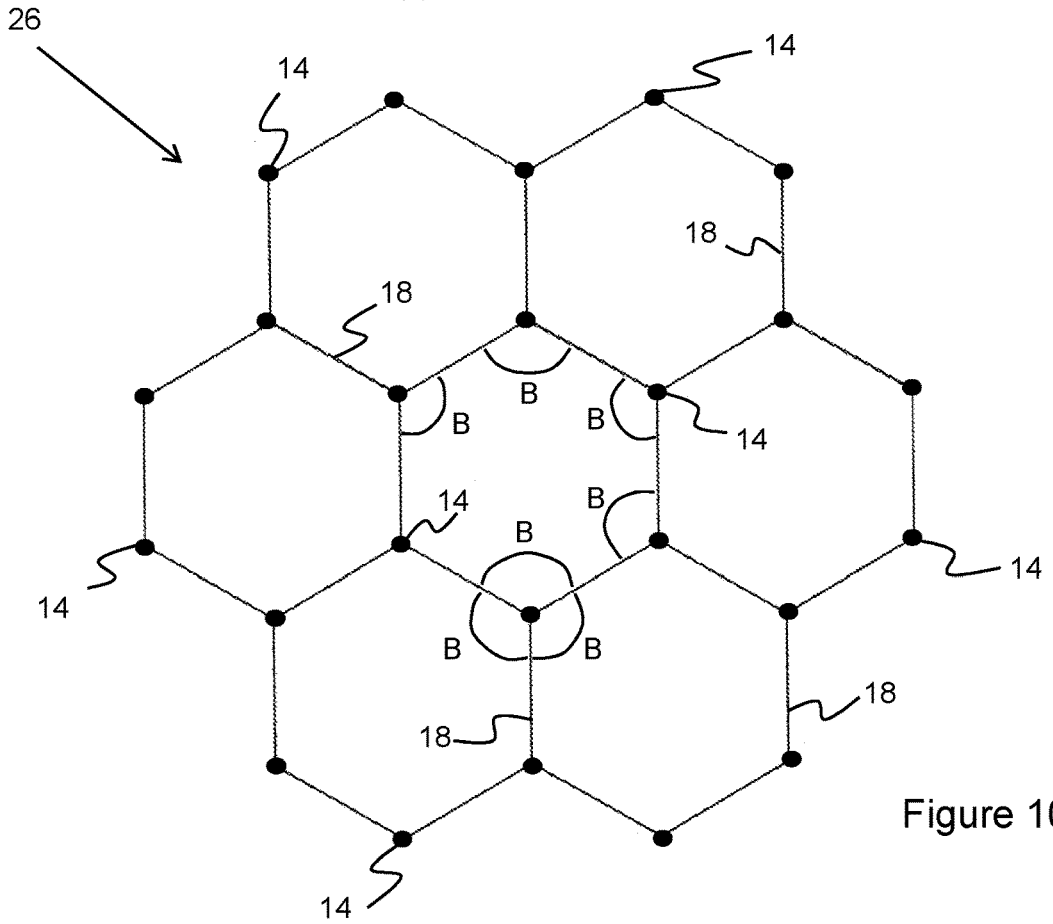
Figure 11:
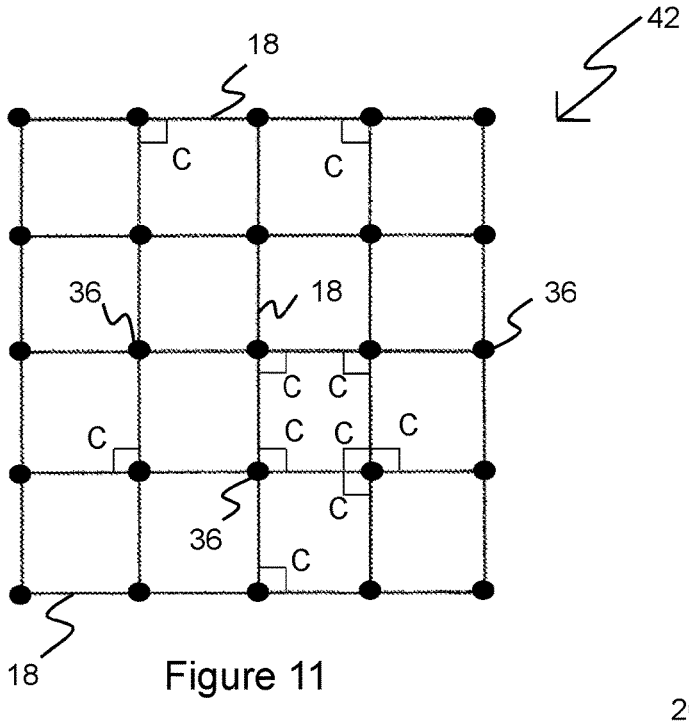

The same intersection members 14, 16 and support members 18 can be used to form a grid 26 whereby the ends of adjacent support members 18 engaged in intersection members 14, 16 form an angle of 120° represented as B in FIGS. 5, 8*a* and 10. Angle B is the interior angle of a hexagon. The openings of the grid 26 therefore can receive and suspend hexagonal shaped ceiling panels 25, see FIGS. 5, 8*a* and 10. The same intersection members 14, 16 can be used to form an assembly for suspending panels of equilateral triangle shape or hexagonal shape or a combination therefore, depending on the configuration of members 14, 16, 18.

Further embodiments of the present invention are directed to similar assemblies as described above but for suspending ceiling panels having square, octagonal or pentagonal shaped ceiling panels, see FIGS. 11 to 19. The angle between ends of adjacent support members engaged in the intersection members 36, 38, 40 can form angles C, D and E being respectively angles of 90°, 135° and 108° (corresponding to the interior angles of quadrilaterals, octagons and pentagons) to form the exemplary grids 42, 44, 46. The openings of grids 42, 44, 46 can receive ceiling panels having the shapes of squares, octagons and pentagons. While the grid 42 is for suspending square ceiling panels, it can be understood that any quadrilateral ceiling panels, such as rectangular panels could be utilized by varying the length of the support members 18 as appropriate.

FIG. 3A is a view of an assembly having two frames 8, 10 in a spaced apart vertical configuration. The intersection member 14, 16 of each frame 8, 10 is engageable with the suspension members 12 such that one intersection member 16 of the two frames 8, 10 is supported above the other intersection member 14, each frame being able to receive at least one ceiling panel 6. The intersection members 14, 16 attach to the suspension members 12 by a fastener 50 such as a suspension clip. The fastener 50 is releasably attachable to the suspension member 12 such that the intersection member 14, 16 can be movably adjustable along the length of the suspension member 12, which can be in the form of a rod, to allow adjustment of the vertical distance between the frames 8, 10 or the adjustment of the height of the suspended ceiling. The intersection members 14, 16 can be attached to the fasteners 50, in particular the lower end portion of the fastener 50 is configured as a hook 58 which can be received in an apertured portion 52 of the intersection members 14, 16.

Each intersection member 16 on an upper portion of the suspension member 12 has an opening 54 configured to allow the suspension member 12 to be received therethrough such that an axis of the suspension member 12 is substantially parallel to an axis of the intersection member 16 so that the intersection members 14, 16 are spaced-apart substantially vertically one above the other. As shown more particularly in FIG. 8*b*, the aperture 54 is substantially the size of the diameter of the suspension member 12 and is preferably centrally located within a base 15 of the intersection member 16. In a preferred embodiment, there is a transverse element internal to the intersection member 16, the transverse element 55 having a second aperture 57 and where the transverse element 55 is spaced apart from the base 15 along the longitudinal axis within the body of the intersection member 16 to ensure that the intersection members 14, 16 are accurately positioned vertically, one above the other.

Figure 4:
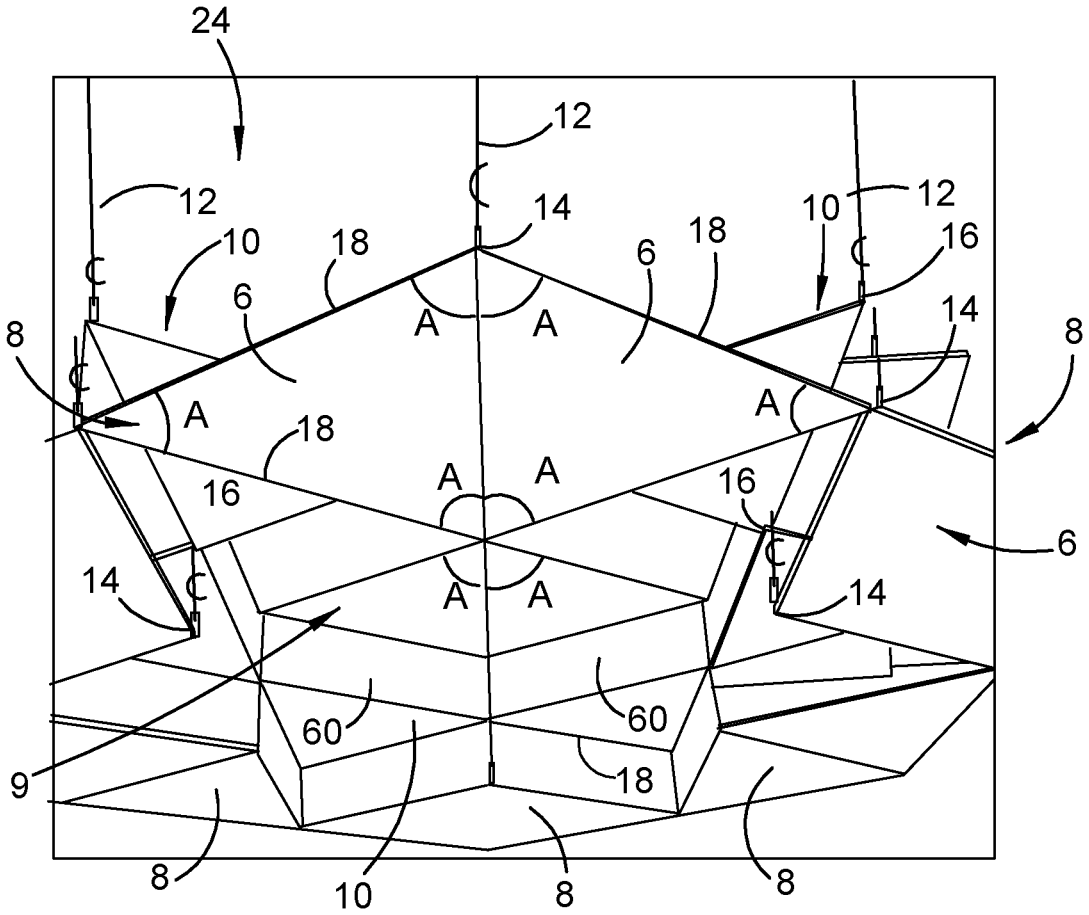
FIGS. 4 and 5 are examples of a suspended ceiling having an assembly for suspending ceiling panels of triangular and hexagonal form respectively.

An example suspended ceiling 24 having three levels is shown in FIG. 4. Further frames could be engaged with the suspension members 12 so as to provide a suspended ceiling with four or more levels. Alternatively the assemblies can be arranged with the intersection members 36, 38, 40 as shown in FIGS. 12, 13, 15, 16 and 19 so as to form a suspended ceiling with one or more levels having quadrilateral, pentagonal or octagonal shaped ceiling panels or combinations thereof.

It will be apparent that in the described assemblies of completed form can have ceiling panels received in the openings so that the ceiling panels present a complete false ceiling. In the suspended ceiling having two or three levels, each level does not need to be occupied by ceiling panels so they are viewed from below of complete coverage. To provide such coverage, ceiling panels 60 can be received between adjacent intersection members 14, 16 on the same suspension member 12 such that the ceiling panels 60 lie perpendicular to the plane of the frames 8, 10.

Figure 9:
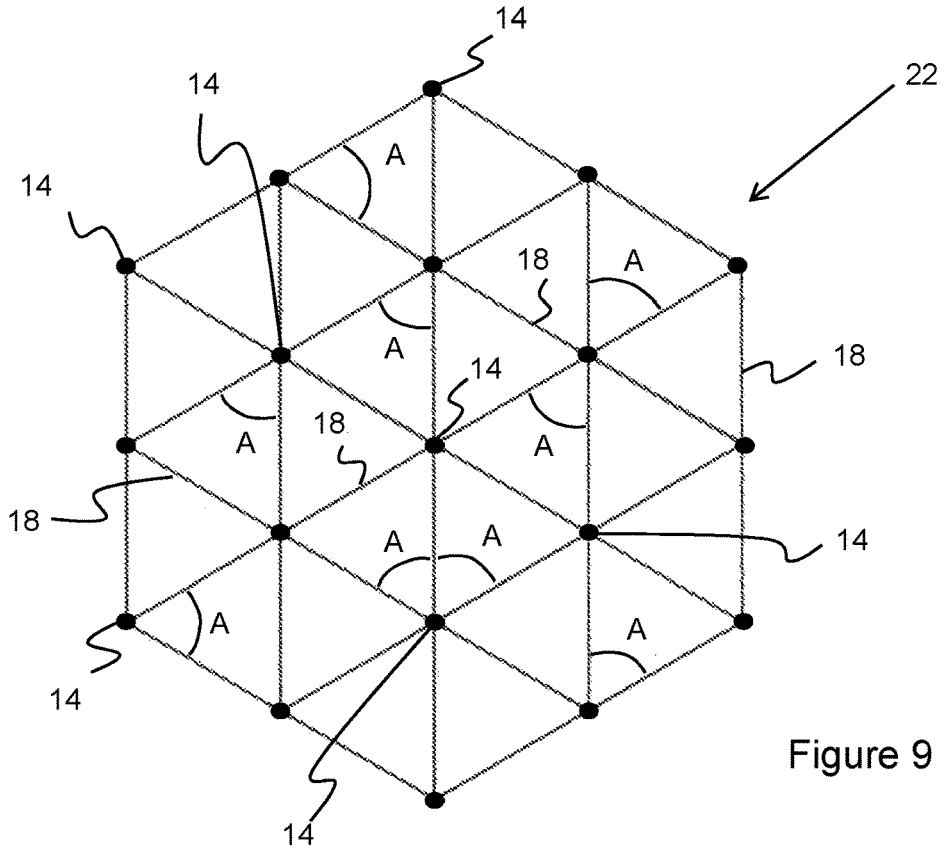
FIGS. 9 to 11 are schematic diagrams of example grids formed by assemblies having intersection members and support members for suspending triangular, hexagonal and square shaped ceiling panels respectively according to further embodiments of the invention.

In an example use of the present invention, a user can assemble a suspended ceiling with ceiling panels having an equilateral triangle shape 6. The user can first assemble a frame 8 with intersection members 14 where the ends of six support members 18 are engaged with each of the six engageable portions 20 provided equiangularly about each of the intersection members 14 so as to form a grid 22, see FIG. 9. The ends of adjacent support members 18 form an angle A of 60° (the interior angle of an equilateral triangle). The user can then attach each intersection member 14 to a fastener 50 on a rod-shaped suspension member 12, the top portion of which is fixed to structure such as a ceiling of a room or an interior surface of a roof. The suspended ceiling 24 is thereby formed when the user provides equilateral triangle shaped ceiling panels 6 in the correspondingly shaped recesses formed by the grid 22, the panels being held in the respective recesses by flanges provided on the support members 18.

In order to form a suspended ceiling with multiple levels, the user can assemble a second frame 10 which is spaced apart vertically above the first frame 8, in the same way as described for the first frame 8 above. The user can then attach the second frame 10 to an upper portion of the suspension member 12 by a second fastener 50. The resultant assembly has first and second frames 8, 10 which are substantially parallel but spaced apart as shown in FIG. 3A.

Similarly, a user can form assemblies for suspending ceiling panels having a quadrilateral, hexagonal, pentagonal or octagonal shapes with the intersection members 14, 16, 36, 38, 40 and support members 18 of FIGS. 12, 13, 15, 16 and 19. In the example of octagonal shaped ceiling panels, each intersection member 38 receives ends of three support members 18 to form two angles D of 135° and one angle C of 90° thereby forming the grid 32 having both octagonal and square shaped recesses to configured to receive correspondingly shaped octagonal and square ceiling panels, see FIG. 16. Although eight engageable portions 20 are shown on the intersection member 38, clearly at a minimum only three engageable portions which form the two angles D of 135° and one angle C of 90° as described above would be necessary to form the required assembly. It can be understood that the intersection members 38 may also be used to form a grid 30 for suspending ceiling panels having only quadrilateral shaped recesses.

Figure 18:
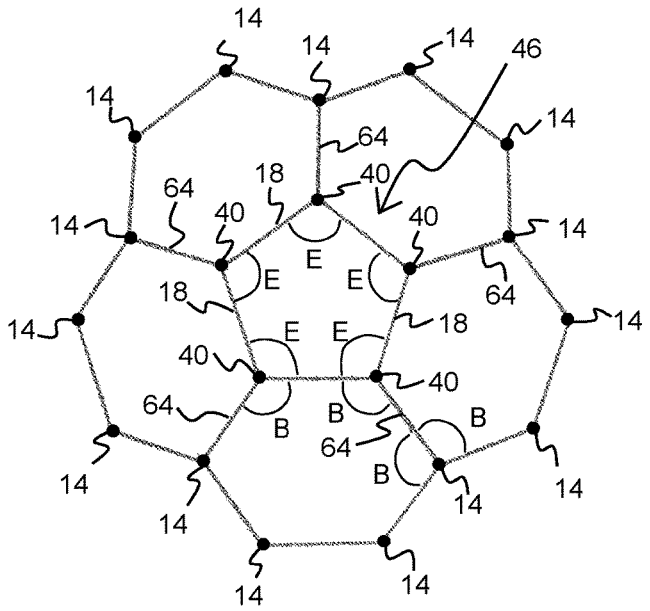
Figure 19:
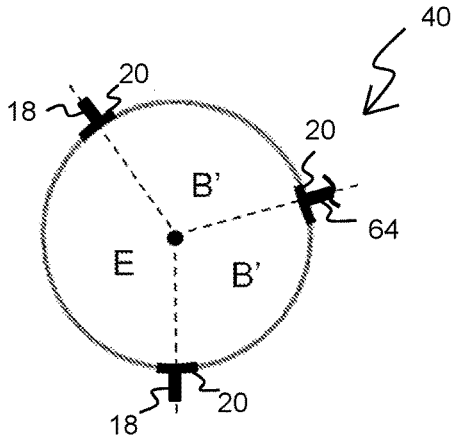
FIG. 19 is a cross-sectional view of an intersection member for use in the grid of FIGS. 17 and 18 with engaged support members.

FIGS. 9 to 11, 14 show exemplary grids which are substantially planar, however FIGS. 18 and 19 are schematic diagrams showing an opening 46 for suspension of a pentagonal shaped ceiling panel which is the apex of a dome-like grid 62. The dome-like grid 62 is formed by intersection members 40 that can have two adjacent support members 18 engaged therein to form an angle which corresponds to the interior angle of a pentagon, represented as angle E of 108°. The other support member 64 forms angles, B' of 126° each, with the first two adjacent support members 18. If the support members 64 are angled away, for example downwards or upwards from the plane of the pentagonal shaped opening 46, the angle formed by the support members 18, 64 decreases to 120°, represented as angle B, to accommodate the interior angle of a hexagon shaped ceiling panel, thereby forming the dome-like grid 62.

The described formation of the intersection members 14, 16, 36, 38, 40, as having engageable portions in the form of slot like apertures enables these to be used to interconnect with support members 18 of a variety of commercially available ceiling support systems. The support members of these systems generally have inverted T-shaped cross sectional form with a central web, upright in use, and sidewardly extended flanges, one to either side of the central web and at a lower edge of the central web in use of the support members. Notwithstanding this similarity, support members from different systems are generally incompatible with each other in the sense that the end protrusions of the support members and the configuration of slots, formed in the central webs, and, which accept the end protrusions are differently configured, such that interchangeability is precluded. This incompatibility may for example particularly arise because intersections between support members are formed by passing end protrusions of two support members oppositely into a single slot in another support member, such that the protrusions cooperate with each other and with the slot to effect latching. On the other hand, with the described arrangements of this invention, this incompatibility problem is lessened because the engageable portions 20 only need to accommodate one protrusion. It has been found that forming the engageable portions 20 as elongate rectangular apertures of about 3 mm width by 12 mm length, in the axial direction of the intersection member, enables protrusions of various commercially available support members to be used in practicing the invention. The dimensions of the rectangular apertures can vary in length by one or two mm so as to accommodate the variable dimensions of the commercially available support members, so that the apertures can be between 11 to 13 mm in length and 1 to 3 mm wide.

As particularly illustrated, these apertures may terminate close to the base 15 and with the longer dimensions of the slots aligned in the axial direction of the intersection members. The length of the apertures 11 in the axial direction of the intersection members may be chosen to suit a particular form of protrusions 17 of the support members 18 being used. As shown the length may be somewhat greater than the upper to lower edge dimension of the protrusions. This may enable use of the intersection members of various different forms of support members, although it may be preferable, mechanically, to make the length only a clearance fit with the upper to lower edge dimension.

Figure 12:
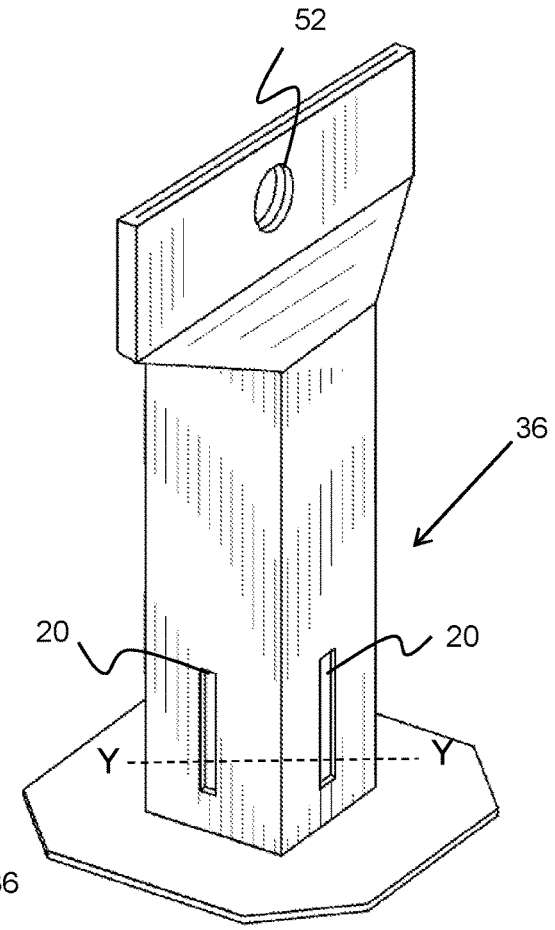
FIG. 12 is a perspective view of an intersection member for assembly for suspending quadrilateral shaped ceiling panels.
Figure 13:
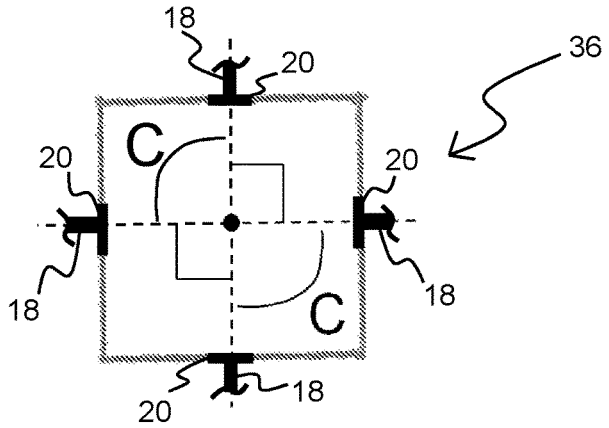
FIG. 13 is a cross-sectional view of an intersection member shown in FIG. 12 taken through the line marked as Y-Y with engaged support members.
Figure 14:
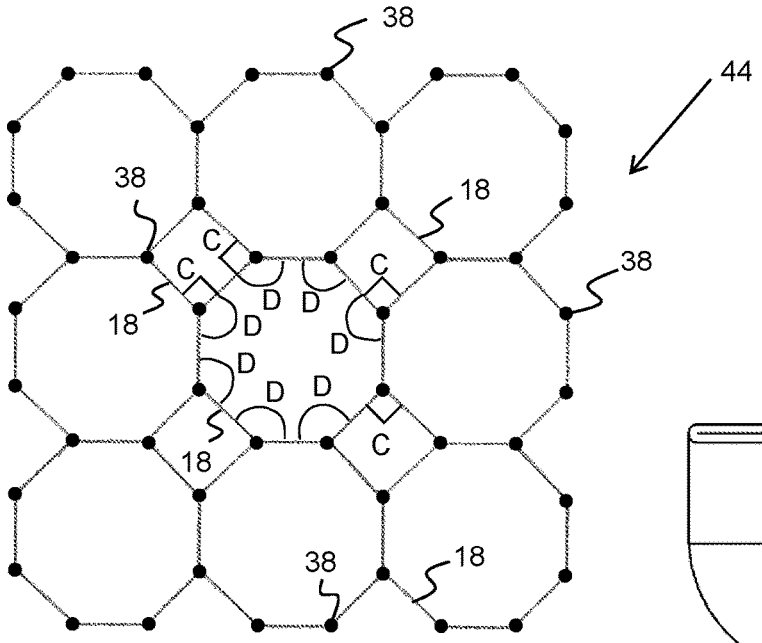
FIG. 14 shows a schematic diagram of a example grid for suspending octagonal shaped ceiling panels according to another embodiment of the invention.
Figure 15:
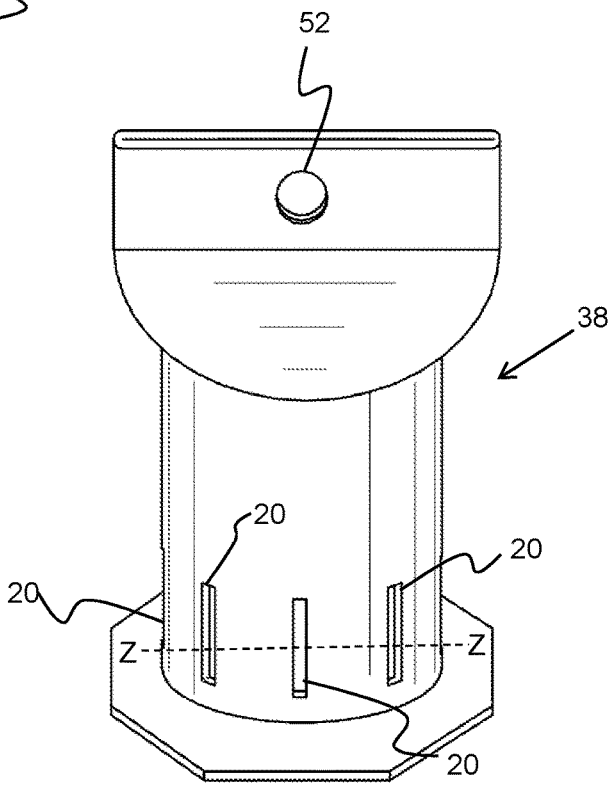
FIG. 15 is a perspective view of an intersection member for assembly of a grid as shown in FIG. 14.
Figure 16:
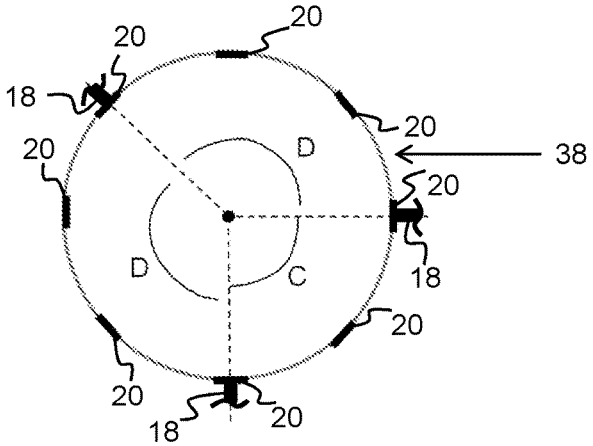
FIG. 16 is a cross-sectional view of the intersection member shown in FIG. 15 taken through the line marked as Z-Z with engaged support members.
Figure 17:
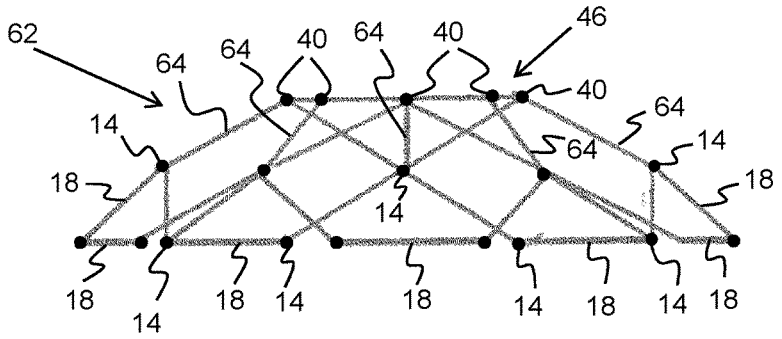
FIGS. 17 and 18 are side and top views of a schematic diagram for an example grid for suspending a pentagonal shaped ceiling panel surrounded by hexagonally shaped ceiling panels according to another embodiment of the invention.

The configuration of the described intersection members as having a generally tubular mounting member 19 and a base 15, of polyhedral form with the number of edge surfaces 15*a* corresponding to the number of engageable portions 20, enables a neat appearance of the completed ceiling to be achieved, as for example, shown in FIG. 5. That is, the base 15 effectively covers the region where the protrusion 17 engaged with the engageable portions 20. Also, as described with reference to FIG. 3K, the edge surface 13*a* of each support member 18 neatly engages an adjacent edge surface 15*a*, likewise presenting a neat finish. As evident from FIGS. 6 and 7, for example, the edge surfaces 15*a* of the base 15 are, when the depicted intersection member is viewed in plan, disposed at 90 degrees to an imaginary line from the axis of the intersection member through the engageable portion 20 and, when viewed from the side, each engageable portion is disposed centrally with respect to the adjacent surface 15*a*. Generally, the form of the base may be polyhedral, with the number of sides corresponding to the number of engageable portions 20, as mentioned. Thus, the base may be regular polygonal although, for example, corners of the polygonal form may be cut off as illustrated in FIG. 12. The latter may still present a neater appearance when viewed from the underside provided the side-to-side width of the flanges of the support members does not exceed the width of the "non-cutoff" side edge surfaces 15*a* where these abut the surfaces 13*a* of the flanges 13 although, generally, the edge surfaces 15*a* may be rather longer than the lengths of the surfaces 13*a*. Generally, too, the base 15 provides support portions 15*b* shown for example in FIG. 3E, one supporting each support member fitted to the intersection member, and thus arrayed in an array about the axis of the intersection member, preferably equiangularly arrayed as shown for example in FIG. 8A.

In the described arrangements, the latching between the engageable portions 20 and the support members 18 is effective to prevent inwards and outwards movement of the support members relative to the intersection members. This may effectively lock support members to the intersection members in the sense that they cannot be separated without defamation of one or more components, permanent or otherwise.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The claims defining the invention are as follows:

1. An intersection member having engageable portions arranged about a periphery of a mounting member thereof, the mounting member being of tubular configuration and defining a body having a height extending in a longitudinal direction and having an interior surface, the interior surface being defined along the mounting member about each engageable portion, the engageable portions being apertures through a wall of the mounting member and being adapted to receive and engage with end protrusions of support members of a suspended ceiling, wherein the body has an apertured portion at an upper end thereof, which is integral with the body and defines an opening that is configured to allow a suspension member to be received therethrough, wherein the opening defines a central axis that extends in a direction that is perpendicular with respect to the longitudinal direction, and wherein the opening is completely bounded by the apertured portion of the body.

2. The intersection member as claimed in claim 1, wherein the engageable portions are slots that extend in an axial direction of the mounting member.

3. The intersection member as claimed in claim 1, wherein engageable portions are arranged equiangularly about the intersection member.

4. The intersection member as claimed in claim 1, wherein the engageable portions are arranged about the mounting member such that an angle formed between an adjacent two of the end protrusions of the support members that are engaged within adjacent two of the engageable portions corresponds to a respective interior angle of a ceiling panel supported by the support members.

5. The intersection member as claimed in claim 4, wherein the angle formed between an adjacent two of the end protrusions of the support members that are engaged within adjacent two of the engageable portions is one of about 60°, about 90°, about 108°, about 120°, or about 135°.

6. The intersection member as claimed in claim 1, wherein the engageable portions are disposed adjacent an end of the mounting member at which there is provided a base extending outwardly from the mounting member, the base defining an array of outwardly extending support portions for support thereon of support members having the protrusions thereof received in the engageable portions.

7. The intersection member as claimed in claim 6, wherein the engageable portions and support portions are aligned with one another around the intersection member.

8. The intersection member according to claim 1, wherein the intersection member has a transverse element internal to the mounting member, the transverse element having a further aperture and being spaced apart from a base of the intersection member.

9. The intersection member according to claim 8, wherein a lower end portion of a fastener is configured as a hook that is receivable in the further aperture of the transverse element, the fastener being engageable with, and releasably moveable relative to, the suspension member, whereby in use, a position of the intersection member is adjustable relative to the suspension member.

10. The intersection member according to claim 1, wherein each of the engageable portions are configured to latchingly engage with the end protrusion of each of the support members, once the end protrusion has been passed therethrough.

11. The intersection member according to claim 10, wherein the engageable portions are configured to latchingly engage with at least one locating member provided at the end protrusion of each of the support members, the at least one locating member inhibiting withdrawal of the end protrusion from a respective one of the engageable portions once it has been passed therethrough.

12. The intersection member according to claim 11, wherein the at least one locating member for inhibiting withdrawal of the end protrusion is in a form of a resilient tongue, wherein, when the at least one locating member is inserted into the aperture of the respective one of the engageable portions, a side edge of the aperture engages and depresses the tongue so the tongue is insertable through the aperture, and wherein, when the end protrusion and tongue have passed through the aperture, the tongue moves outwardly under resilient bias to engage with the interior surface of the mounting member to inhibit withdrawal of the end protrusion of the support member.

13. The intersection member according to claim 1, wherein the intersection member further comprises a base that extends radially outwardly from an end of the mounting member.

14. The intersection member according to claim 13, wherein the engageable portions are disposed circumferentially about the mounting member adjacent the base.

15. The intersection member as claimed in claim 13, wherein the base defines an array of outwardly extending support portions, each of the support portions being adapted to support thereon one of the support members once the end protrusion of the support member has passed through a respective one of the engageable portions.

16. An intersection member having engageable portions arranged about a periphery of a mounting member thereof, the mounting member being of tubular configuration and the engageable portions being apertures through a wall of the mounting member and receiving and engaging with end protrusions of support members of a suspended ceiling, the intersection member being adapted such that, when so received, the end protrusions protrude through the engageable portions into an interior portion of the mounting member whereby respective ends of said support members locate proximal to one another therein, and whereby said support members extend outwardly therefrom away from the mounting member to provide support for ceiling panels.

17. The intersection member according to claim 16, wherein the intersection member is adapted such that, when so received, a terminal end of the end protrusions are able to locate radially closer to a geometric center of the mounting member than any portion of the interior surface of the mounting member.

* * * * *